US010243305B1

(12) United States Patent
Pan et al.

(10) Patent No.: US 10,243,305 B1
(45) Date of Patent: Mar. 26, 2019

(54) ELECTRICAL CONNECTOR ASSEMBLY

(71) Applicant: LUXSHARE PRECISION INDUSTRY Co., Ltd., Shenzhen (CN)

(72) Inventors: Feng Pan, Shenzhen (CN); Frank Zhang, Shenzhen (CN); Bin Huang, Shenzhen (CN); Kun-Lin Yao, Shenzhen (CN)

(73) Assignee: LUXSHARE PRECISION INDUSTRY CO., LTD., Shenzhen (CN)

( * ) Notice: Subject to any disclaimer, the term of this patent is extended or adjusted under 35 U.S.C. 154(b) by 0 days.

(21) Appl. No.: 15/951,413

(22) Filed: Apr. 12, 2018

(51) Int. Cl.

| | |
|---|---|
| ***H01R 13/648*** | (2006.01) |
| ***H01R 13/66*** | (2006.01) |
| ***H01R 13/506*** | (2006.01) |
| ***H01R 12/71*** | (2011.01) |
| ***H01R 13/6582*** | (2011.01) |
| *H01R 24/60* | (2011.01) |

(52) U.S. Cl.
CPC ..... *H01R 13/665* (2013.01); *H01R 12/716* (2013.01); *H01R 13/506* (2013.01); *H01R 13/6582* (2013.01); *H01R 24/60* (2013.01)

(58) Field of Classification Search
CPC ..... H01R 13/665; H01R 13/6582; H01R 12/716; H01R 13/506; H01R 24/60
USPC ..... 439/76.1, 607.2, 607.21, 353, 354, 357, 439/660, 607.35, 607.4
See application file for complete search history.

(56) References Cited

U.S. PATENT DOCUMENTS

| | | | | |
|---|---|---|---|---|
| 4,734,045 A * | 3/1988 | Hawkins | H01R 12/52 | 439/592 |
| 6,780,053 B1 * | 8/2004 | Yunker | G02B 6/4201 | 439/607.2 |
| 7,566,244 B1 * | 7/2009 | Nguyen | G02B 6/4201 | 439/607.2 |
| 8,052,467 B1 * | 11/2011 | Xie | H01R 13/6594 | 439/589 |
| 8,129,630 B2 * | 3/2012 | Moore | G02B 6/4201 | 174/384 |
| 8,358,504 B2 * | 1/2013 | McColloch | G02B 6/4269 | 361/679.46 |
| 8,449,331 B2 * | 5/2013 | Phillips | H01R 13/6581 | 439/607.21 |
| 8,535,096 B1 * | 9/2013 | Shirk | H01R 13/648 | 439/374 |

(Continued)

*Primary Examiner* — Abdullah A Riyami
*Assistant Examiner* — Nelson R. Burgos-Guntin
(74) *Attorney, Agent, or Firm* — Birch, Stewart, Kolasch & Birch, LLP

(57) ABSTRACT

An electrical connector assembly includes a metal housing for being installed on a printed circuit board, a first connector, and a second connector. The metal housing is provided with a receiving space. The receiving space has a first insertion opening and a second insertion opening, the first insertion opening is located at the front end of the metal housing, and the second insertion opening is located at the rear end of the metal housing. The first connector is inserted into the receiving space through the first insertion opening, and the second connector is inserted into the receiving space through the second insertion opening and butted with the first connector. The first connector and the metal housing are permanently locked with each other by a buckle structure therebetween, such that the first connector cannot be disengaged from the metal housing.

10 Claims, 6 Drawing Sheets

(56) References Cited

U.S. PATENT DOCUMENTS

| | | | | |
|---|---|---|---|---|
| 8,613,632 | B1 * | 12/2013 | Nichols | H01R 13/6587 439/485 |
| 10,079,442 | B2 * | 9/2018 | Arekar | H01R 12/7058 |
| 2003/0124899 | A1 * | 7/2003 | Ushiro | H01R 13/743 439/357 |
| 2004/0077217 | A1 * | 4/2004 | Hwang | H05K 9/0058 439/607.2 |
| 2004/0203289 | A1 * | 10/2004 | Ice | G02B 6/4277 439/607.2 |
| 2006/0252311 | A1 * | 11/2006 | Togami | G02B 6/4277 439/607.2 |
| 2014/0273571 | A1 * | 9/2014 | Iyer | H01R 13/53 439/183 |
| 2015/0031246 | A1 * | 1/2015 | Wu | H01R 13/6473 439/660 |
| 2016/0079720 | A1 * | 3/2016 | Zhong | H01R 24/66 439/660 |

* cited by examiner

ELECTRICAL CONNECTOR ASSEMBLY

BACKGROUND

Technical Field

The present invention relates to an electrical connector assembly, and particularly to an electrical connector assembly having a metal housing, the metal housing being installed on a printed circuit board.

Related Art

An electronic system is generally manufactured from a plurality of interconnecting assemblies, and an electronic device such as a computer generally includes electronic components attached to a printed circuit board. One or more printed circuit boards may be positioned in a holder or other support structures and interconnected, so that data or other signals may be processed by components on different printed circuit boards.

Frequently, an electrical connector is used to form an interconnection between printed circuit boards. In order to form such an interconnection, an electrical connector is attached to each printed circuit board to be connected, and these boards are positioned such that the connectors are mated to generate a signal path between the boards. A signal can be transferred from one board to another board through a connector, thereby allowing electronic components on different printed circuit boards to work together. This connector using manner facilitates the assembly of complex devices because all parts of the device can be manufactured on separate boards and then assembled. The use of the connector also facilitates the maintenance of the electronic device because a board can be added to a system after being assembled so as to increase functionality or replace a defective board.

In some cases, the electronic system is more complex or is required to cross a wider region than a region that can actually be achieved by assembling the board into the holder. However, it is known to use cables to interconnect devices that can be spaced far apart. In this case, a cable connector designed to form a connection between a conductor of a cable and a conductor of a printed circuit board in a device may be used. The cable connector may be separable where cable ends terminate with a cable connector sometimes referred to as a "male". A printed circuit board in an electronic device may include a connector receiving a male plug installation board, sometimes referred to as a "female". The female is positioned near an opening in the outer surface of the device, sometimes referred to as a "panel," rather than being installed to align with a connector on another board. The male may be inserted through the opening in the panel to be mated with the female, thereby completing a connection between the cable and the electronic components in the device.

A female connector generally includes a metal housing, an insulating body, and conductive terminals received in the insulating body. The metal housing generally surrounds the insulating body and the conductive terminals and provides a shielding function. Some female connectors are installed on a printed circuit board after the metal housing and the insulating body are assembled together, so installation can be completed at one time. For a small number of female connectors, the insulating body and the conductive terminals are installed on the printed circuit board first, the metal housing is then installed on the printed circuit board, and the metal housing and the insulating body are combined together. Thus, a secondary installation process is required.

SUMMARY

An object of the present invention is to provide an electrical connector assembly which is easy to operate and of which the cost is reduced.

To achieve the foregoing object, the present invention adopts the following technical solution: an electrical connector assembly includes a metal housing used for being installed on a printed circuit board, a first connector, and a second connector, the metal housing being provided with a receiving space, wherein the receiving space has a first insertion opening and a second insertion opening, the first insertion opening is located at the front end of the metal housing, the second insertion opening is located at the rear end of the metal housing, wherein the first connector is inserted into the receiving space through the first insertion opening, the second connector is inserted into the receiving space through the second insertion opening and butted with the first connector, wherein the first connector and the metal housing are permanently locked with each other by a buckle structure therebetween.

As a further improvement of the present invention, the buckle structure is configured as a buckle elastic piece and a buckle groove, buckled together.

As a further improvement of the present invention, the buckle structure is configured as a buckle hole and a buckle protruding block, buckled together, the buckle protruding block having an inclination plane for guiding the buckle protruding block to enter the buckle hole.

As a further improvement of the present invention, the metal housing is provided with a stopping piece for stopping the first connector to limit the first connector from being too deep inserted.

As a further improvement of the present invention, the metal housing includes a top wall, a bottom wall, and two opposite side walls connecting the top wall and the bottom wall, the receiving space is located between the top wall, the bottom wall and the two side walls, the side wall is provided with a buckle hole penetrating through the side wall and installation legs used for being installed on the printed circuit board, and the first connector is provided with a buckle protruding block buckled with the buckle hole.

As a further improvement of the present invention, the metal housing includes a top wall, a bottom wall, and two opposite side walls connecting the top wall and the bottom wall, the receiving space is located between the top wall, the bottom wall and the two side walls, the top wall or the bottom wall is provided with a buckle elastic piece, and the first connector is provided with a buckle groove buckled with the buckle elastic piece.

As a further improvement of the present invention, the metal housing further includes an inner top wall located between the top wall and the bottom wall, the first insertion opening is located between the inner top wall, the bottom wall and the two side walls, the inner top wall is also provided with a buckle elastic piece, and the first connector is provided with a buckle groove buckled with the buckle elastic piece.

As a further improvement of the present invention, the first connector is a female connector, including an insulating body, conductive terminals, a metal shell, an insulating shell, and a cable; the insulating body is provided with an insertion hole allowing insertion of the second connector; the conductive terminal has a contact portion extending into the insertion hole and a connecting portion connected to the cable; the insulating shell wraps the insulating body and the metal shell; the insulating body and the metal shell protrude forwards out of the insulating shell; and the metal housing is provided with a stopping piece urging against the front edge of the insulating shell to limit too-deep insertion.

As a further improvement of the present invention, the buckle groove is provided on the surface of the insulating shell.

As a further improvement of the present invention, the metal housing is provided with a buckle hole, and the insulating shell is provided with a buckle protruding block buckled into the buckle hole.

According to the electrical connector assembly of the present invention, the buckle structure for locking the first connector in the metal housing is disposed between the metal housing and the first connector, such that the first connector cannot be disengaged from the metal housing, thereby omitting the process of installing the first connector on the printed circuit board. The operation is easy, which is conducive to cost reduction. Moreover, a reliable connection between the first connector and the second connector is ensured.

DETAILED DESCRIPTION

Figure 1:
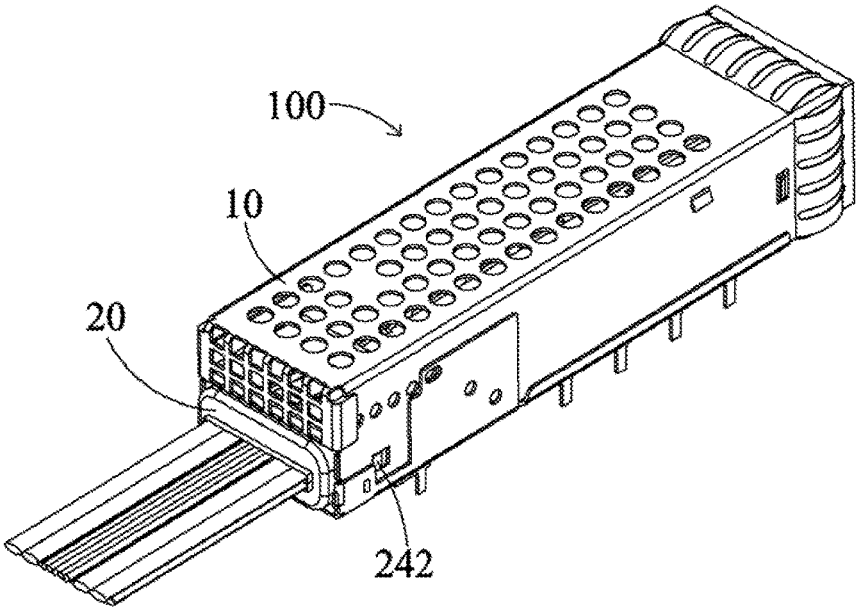
FIG. 1 is a three-dimensional schematic diagram of an electrical connector assembly according to the present invention.
Figure 2:
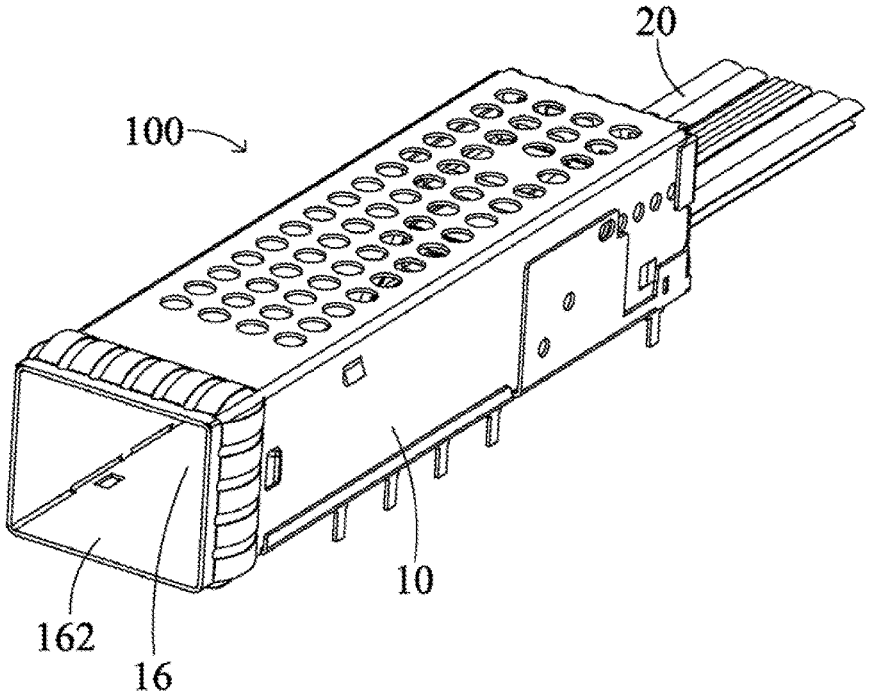
FIG. 2 is a three-dimensional schematic diagram of an electrical connector assembly from another perspective according to the present invention.
Figure 3:
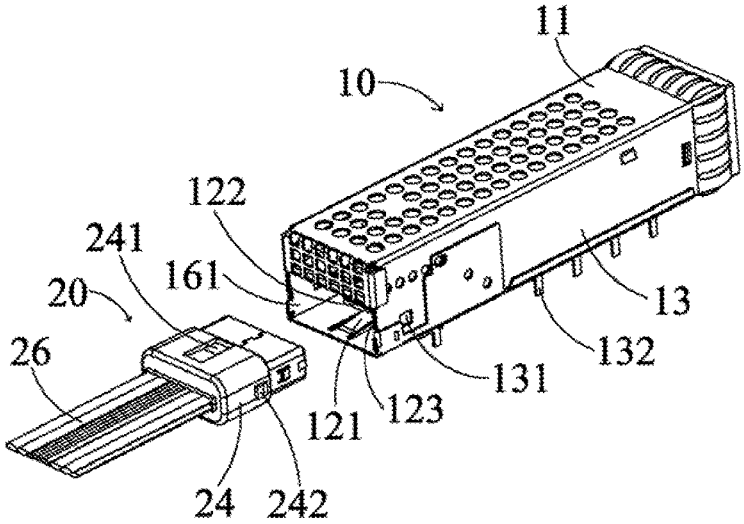
FIG. 3 is a three-dimensional schematic diagram illustrating separation of a first connector and a metal housing in an electrical connector assembly according to the present invention.
Figure 4:
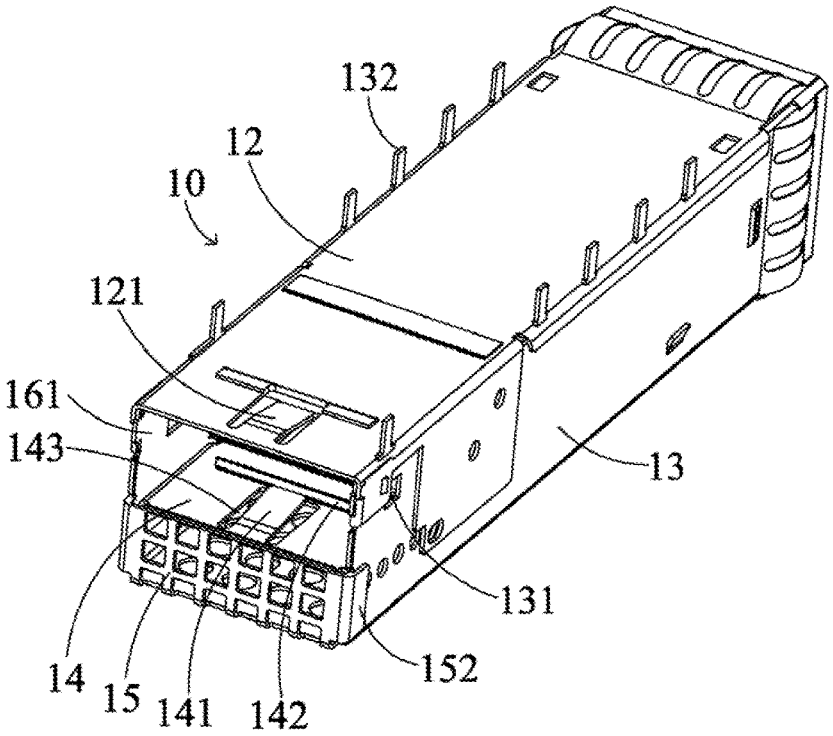
FIG. 4 is a three-dimensional view of a metal housing of an electrical connector assembly according to the present invention.

As shown in FIG. 1 to FIG. 6, an electrical connector assembly 100 of the present invention includes a metal housing 10, a first connector 20, and a second connector (not shown). The first connector 20 and the second connector face each other in a front-rear direction, and are inserted into the metal housing 10 and butted with each other, the first connector 20 is a female connector, and the second connector is a male connector.

The metal housing 10 is provided with a receiving space 16 allowing insertion of the first connector 20 and the second connector, and the receiving space 16 has a first insertion opening 161 at the front end of the metal housing 10 and a second insertion opening 162 at the rear end of the metal housing 10.

The metal housing 10 includes a top wall 11, a bottom wall 12 opposite to the top wall 11, two opposite side walls 13 connecting the top wall 11 and the bottom wall 12, an inner top wall 14 located between the two side walls 13, and a front end wall 15 bending and extending downwards from the front end of the top wall 11. The bottom edge of the front end wall 15 covers the front end of the inner top wall 14, thereby avoiding interference on insertion of the first connector 20 into the first insertion opening 161, the left and right ends of the front end wall 15 are separately provided with a positioning piece 152 perpendicularly bending and extending outwards, and the positioning piece 152 urges against the outer surface of the side wall 13 and may limit the front end wall 15 from moving leftwards and rightwards.

The receiving space 16 is located between the top wall 11, the bottom wall 12 and the two side walls 13, and between the inner top wall 14, the bottom wall 12 and the two side walls 13. The inner top wall 14 is located at the front end of the receiving space 16, the first insertion opening 161 is formed between the inner top wall 14, the bottom wall 12 and the two side walls 13, and the second insertion opening 162 is located between the top wall 11, the bottom wall 12 and the two side walls 13. A buckle elastic piece 121 located in the receiving space 16 and a stopping piece 122 located behind the buckle elastic piece 121 are disposed on the bottom wall 12, and a buckle elastic piece 141 located in the receiving space 16 and a stopping piece 142 located behind the buckle elastic piece 141 are disposed on the inner top wall 14. The buckle elastic pieces 121, 141 extend backwards obliquely, and the bottom wall 12 and the inner top wall 14 have openings 123, 143 reserved for forming the buckle elastic pieces 121, 141. The two side walls 13 are separately provided with a through buckle hole 131 and a plurality of installation legs 132 penetrating downwards through the bottom wall 12, for being fixed to a printed circuit board (not shown).

Figure 5:
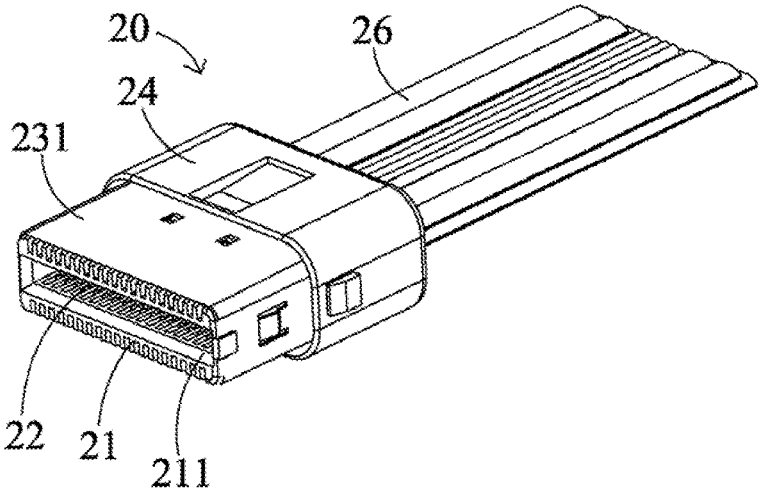
FIG. 5 is a three-dimensional view of a first connector of an electrical connector assembly according to the present invention.
Figure 6:
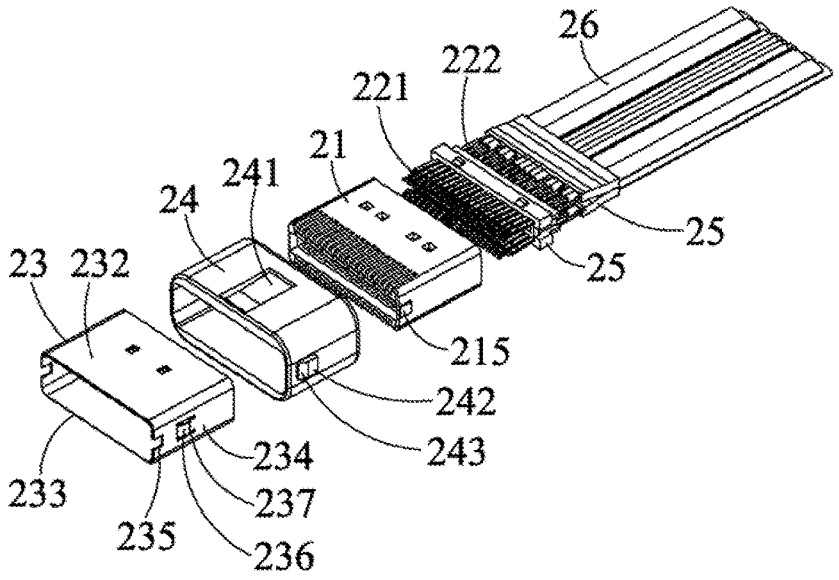
FIG. 6 is a three-dimensional exploded view of a first connector of an electrical connector assembly according to the present invention.

As shown in FIG. 5 and FIG. 6, the first connector 20 includes an insulating body 21, a plurality of conductive terminals 22, a metal shell 23, an insulating shell 24, a positioning block 25, and a cable 26. An insertion hole 211 allowing insertion of the second connector is provided at the front end of the insulating body 21, the conductive terminals 22 are received in the insulating body 21, and each conductive terminal 22 has a contact portion 221 extending into the insertion hole 211 and a connecting portion 222 connected to the cable 26.

The metal shell 23 is of a front-hollow and rear-hollow structure, the insulating body 21 is received in the metal shell 23, the metal shell 23 has a mating frame 231 protruding forwards, the mating frame 231 includes a top board 232, a bottom board 233, and two opposite side boards 234 connecting the top board 232 and the bottom board 233, the front ends of the two side boards 234 are separately provided with a notch 235, and a protruding portion 215 positioned in the notch 235 is disposed on the outer surface of the front end of the insulating body 21. The two side boards 234 are also separately provided with a pressed elastic piece 236 protruding outwards and an opening 237 reserved for forming the pressed elastic piece 236, the front and rear ends of the pressed elastic piece 236 are connected to the inner wall of the opening 237, and the pressed elastic piece 236 is also located behind the notch 235.

The insulating shell 24 wraps the rear ends of the insulating body 21 and the metal shell 23, and the insulating body 21 and the metal shell 23 protrude forwards out of the insulating shell 24. The upper and lower surfaces of the insulating shell 24 are respectively provided with buckle grooves 241 corresponding to the buckle elastic pieces 121, 141 of the metal housing 10, and the left and right surfaces are separately provided with a buckle protruding block 242 corresponding to the buckle hole 131 of the metal housing 10 and having a front inclination plane 243.

The positioning block 25 is assembled in the insulating body 21 and the insulating shell 24, the cable 26 is gathered together, and the cable 26 extends backwards out of the insulating shell 24.

The first connector 20 is inserted into the receiving space 16 through the first insertion opening 161 of the metal housing 10, the second connector is inserted into the receiving space 16 through the second insertion opening 162 and butted with the first connector 20, and therefore signal transmission therebetween is realized. The buckle elastic pieces 121, 141 of the metal housing 10 are buckled into the buckle groove 241 of the insulating shell 24, and the buckle protruding block 242 of the insulating body 24 is buckled into the buckle hole 131 of the metal housing 10, so that the first connector 20 is locked, and the first connector 20 cannot be disengaged from the metal housing 10. The stopping pieces 122, 142 urge against the front edge of the insulating shell 24, so as to avoid too-deep insertion of the first connector 20.

According to the electrical connector assembly 100 of the present invention, the metal housing 10 is installed on the printed circuit board first, and then the first connector 20 is inserted into the receiving space 16 of the metal housing 10 and locked permanently by the metal housing 10, such that the first connector 20 cannot be disengaged from the metal housing 10 (unless the metal housing 10 is destroyed), thereby omitting the process of installing the first connector 20 on the printed circuit board. The operation is easy, which is conducive to cost reduction. Moreover, a reliable connection between the first connector 10 and the second connector is ensured.

Although the preferred embodiments of the present invention have been disclosed for illustrative purposes, those of ordinary skill in the art will realize that various improvements, additions and replacements are possible without departing from the scope and spirit of the present invention as disclosed in the appended claims.

What is claimed is:

1. An electrical connector assembly, comprising a metal housing used for being installed on a printed circuit board, a first connector, and a second connector, the metal housing being provided with a receiving space, wherein the receiving space has a first insertion opening and a second insertion opening, the first insertion opening is located at the front end of the metal housing, the second insertion opening is located at the rear end of the metal housing, wherein the first connector is inserted into the receiving space through the first insertion opening, the second connector is inserted into the receiving space through the second insertion opening and butted with the first connector, wherein the first connector and the metal housing are permanently locked with each other by a buckle structure therebetween, the buckle structure is configured as a buckle elastic piece and a buckle groove, the buckle elastic piece is buckled into the buckle groove so that the first connector is permanently locked with the metal housing and cannot be disengaged from the metal housing.

2. The electrical connector assembly according to claim 1, wherein the buckle elastic piece is located in the receiving space and extends backwards obliquely, the buckle groove is on a surface of the first connector, the buckle elastic piece is obliquely buckled into the buckle groove, and an end of the buckle elastic piece is against an end of the buckle groove.

3. The electrical connector assembly according to claim 1, wherein the first connector and the metal housing are permanently locked with each other by another buckle structure therebetween, the buckle structure is configured as a buckle hole and a buckle protruding block, buckled together, and the buckle protruding block has an inclination plane for guiding the buckle protruding block to enter the buckle hole.

4. The electrical connector assembly according to claim 1, wherein the metal housing is provided with a stopping piece for stopping the first connector to limit the first connector from being too deep inserted.

5. The electrical connector assembly according to claim 1, wherein the metal housing comprises a top wall, a bottom wall, and two opposite side walls connecting the top wall and the bottom wall, the receiving space is located between the top wall, the bottom wall and the two side walls, the side wall is provided with a buckle hole penetrating through the side wall and installation legs used for being installed on the printed circuit board, and the first connector is provided with a buckle protruding block buckled with the buckle hole.

6. The electrical connector assembly according to claim 1, wherein the metal housing comprises a top wall, a bottom wall, and two opposite side walls connecting the top wall and the bottom wall, the receiving space is located between the top wall, the bottom wall and the two side walls, the top wall or the bottom wall is provided with the buckle elastic piece, and the first connector is provided with the buckle groove buckled with the buckle elastic piece.

7. The electrical connector assembly according to claim 6, wherein the metal housing further comprises an inner top wall located between the top wall and the bottom wall, the first insertion opening is located between the inner top wall, the bottom wall and the two side walls, the inner top wall is also provided with another buckle elastic piece, and the first connector is provided with another buckle groove buckled with the another buckle elastic piece.

8. An electrical connector assembly, comprising a metal housing used for being installed on a printed circuit board, a first connector, and a second connector, the metal housing being provided with a receiving space, wherein the receiving space has a first insertion opening and a second insertion opening, the first insertion opening is located at the front end of the metal housing, the second insertion opening is located at the rear end of the metal housing, wherein the first connector is inserted into the receiving space through the first insertion opening, the second connector is inserted into the receiving space through the second insertion opening and butted with the first connector, wherein the first connector and the metal housing are permanently locked with each other by a buckle structure therebetween, wherein the first connector is a female connector, comprising an insulating body, conductive terminals, a metal shell, an insulating shell, and a cable; the insulating body is provided with an insertion hole allowing insertion of the second connector; the conductive terminal has a contact portion extending into the insertion hole and a connecting portion connected to the cable; the insulating shell wraps the insulating body and the metal shell; the insulating body and the metal shell protrude forwards out of the insulating shell; and the metal housing is provided with a stopping piece urging against the front edge of the insulating shell to limit too-deep insertion.

9. The electrical connector assembly according to claim 8, wherein the buckle structure is configured as a buckle elastic piece and a buckle groove, buckled together, the buckle groove is provided on the surface of the insulating shell.

10. The electrical connector assembly according to claim 8, wherein the metal housing is provided with a buckle hole, and the insulating shell is provided with a buckle protruding block buckled into the buckle hole.

* * * * *